United States Patent [19]

Zettl

[11] Patent Number: 4,569,472

[45] Date of Patent: Feb. 11, 1986

[54] APPARATUS FOR AUTOMATICALLY SOLDERING JEWELRY CHAINS

[76] Inventor: Friedrich Zettl, Ettlinger Strasse 37, D 7531 Keltem, Fed. Rep. of Germany

[21] Appl. No.: 683,624

[22] Filed: Dec. 19, 1984

[30] Foreign Application Priority Data

Dec. 27, 1983 [DE] Fed. Rep. of Germany ..... 3347139

[51] Int. Cl.[4] ..... B21L 3/02

[52] U.S. Cl. ..... 228/192; 228/9; 59/31

[58] Field of Search ..... 228/9, 10, 13, 192; 219/51, 52; 59/31, 34, 35.1, 18, 16

[56] References Cited

U.S. PATENT DOCUMENTS

| | | | |
|---|---|---|---|
| 3,480,194 | 11/1969 | Seeloff | 228/10 |
| 4,012,618 | 3/1977 | Ebel et al. | 228/192 |
| 4,275,555 | 6/1981 | Bichi | 59/18 |

FOREIGN PATENT DOCUMENTS

| | | | |
|---|---|---|---|
| 2460752 | 3/1981 | France | 228/9 |
| 45-07852 | 3/1970 | Japan | 228/9 |

*Primary Examiner*—Kenneth J. Ramsey
*Assistant Examiner*—Kurt Rowan
*Attorney, Agent, or Firm*—Klaus J. Bach

[57] ABSTRACT

An apparatus for automatically soldering flexible jewelry chains to certain parts such as locks or ornamental members wherein the parts to be soldered to the chain are retained by a retaining device and the chain is disposed on a carrier which is movable toward and away from the retaining device a distance corresponding to the desired length of the chain section to be soldered to the part, the carrier having a gripper for engaging a particular chain link, a chain position sensor arranged next to the gripper so as to sense the position of the link next to the link to be soldered, a control device associated with the position sensor and adapted to correct the carrier position until the correct chain link position is obtained, a cutting mechanism arranged adjacent the gripper for cutting the chain link held by the gripper, and soldering means arranged adjacent the part retaining device for soldering the cut chain link upon movement thereof in abutment with the part to which it is to be soldered.

10 Claims, 10 Drawing Figures

Fig. 1
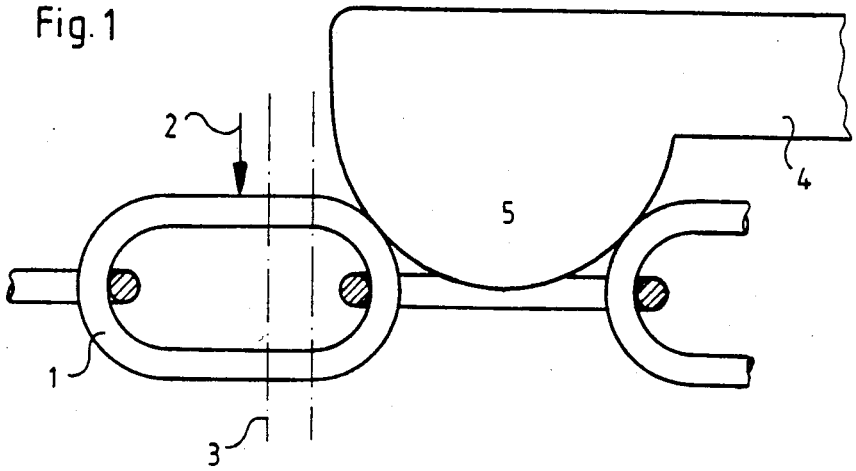
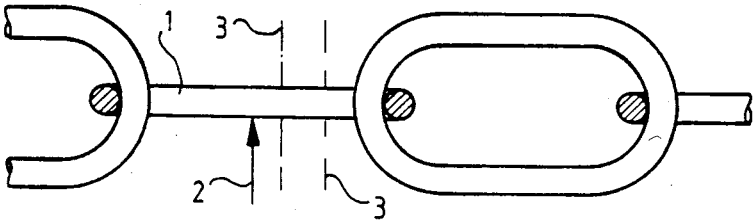
Fig. 2
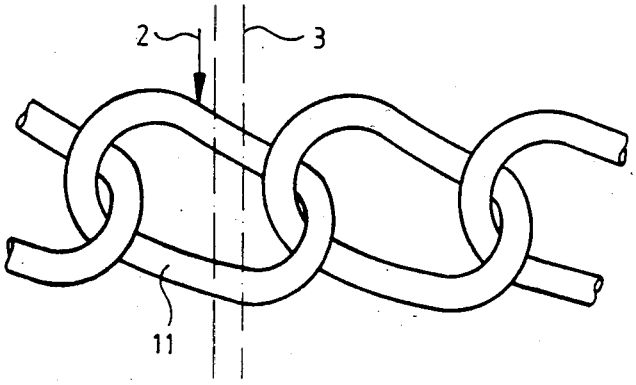
Fig. 3
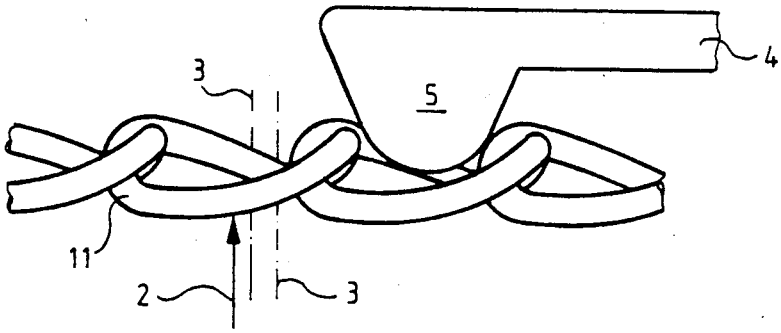
Fig. 4

APPARATUS FOR AUTOMATICALLY SOLDERING JEWELRY CHAINS

BACKGROUND OF THE INVENTION

The invention relates to an apparatus for automatically soldering jewelry chains, especially flexible neck chains, to special chain parts such as locks or pieces of jewelry.

For proper soldering operation, it is important that the chain ends and the jewelry pieces or other pieces to be soldered to the chain ends are held in proper positions relative to one another. In order to be able to hold the end pieces properly by means of grippers, it is necessary that the end links of the chain are previously properly formed by a corresponding cutting step. Generally, a link is to be cut exactly in the middle of its length. If the end link does not have the shape required for gripping or if, during the cutting process, two chain links are cut, the grippers cannot properly hold the end link, that is, it cannot bring the end link into proper position with respect to the counterpiece to which it is to be soldered so that improper, usually unusable, soldering joints are produced. It any case, disturbances in the production process will result.

It is pointed out that for jewelry chains, tensile strength is not of prime importance, it is rather the attractive appearance of the chain which is achieved by various shaping of the chain links. Such shaping of the chain links results in a relatively low longitudinal stability of the chain since only relatively small tension forces may deform the links and lengthen the chain, resulting in a reduction of chain links per length unit. The assumption of a given chain or link length in connection with the design of a cutting apparatus will therefore not lead to the desired result since, on this basis, there is no assurance that a chain link will indeed be cut exactly in the middle.

For a proper operation of an automatic soldering apparatus it is therefore necessary that the end link of a chain is properly held and also, that the link is subsequently properly cut, generally in the middle of the chain link engaged by the apparatus. However, with prior art apparatus neither could be done with the degree of certainty necessary for the manufacture; it was more or less accidental where the grippers engaged the chain and exactly where it was cut. As a result such automatic apparatus could properly handle only inflexible chains which are easier to position and for which the shape of the joint pieces is not as critical as it is with flexible chains. Flexible chains are therefore soldered generally manually with a high reject rate and at relatively high costs.

In order to be able to use automatic soldering apparatus also with flexible chains it has been tried to engage not just one link but a number of somewhat remote links (DE-OS No. 33 02 208, GB-A No. 2084906 and GB-A No. 2115321) to hold and guide the chain in this manner toward the member to be soldered thereto. In this case, the last link to be soldered is not firmly engaged. Actually, it is impossible to engage the last link since the cutting of the chain is random so that the end link is of different shape with each cut, that is, the cut edges of the link are anywhere around the outline of the link. There are many possibilities for the location of the cutting plane depending on the accidental position of the chain end upon cutting which results in different soldering connections and different shapes of the soldered chain ends, many of which are not acceptable by appearance or quality standards.

SUMMARY OF THE INVENTION

In order to provide proper soldering connections with small reject rates, an apparatus for automatically soldering flexible jewelry chains to parts such as locks or ornamental members, the parts to be soldered to the chain are retained in a predetermined position by a retaining device and the chain is supported on a carrier which is movable toward and away from the retaining member by a stepping motor under the control of a computer, for example. The carrier has a gripper for engaging a portion of the chain link to be cut and a chain position sensor is arranged next to the gripper and adapted to sense the position of the chain link next to the chain link to be engaged by the gripper. The position sensor exactly determines the chain link position and provides a position signal to the control computer which is adapted to operate the stepping motor so as to move the carrier with the gripper to the position desired for gripping the link to be cut at a certain distance from the part in the retaining device to which the chain is connected corresponding to the desired chain length. When the chain link to be cut is properly positioned, the gripper engages the chain link and a cutting knife disposed in front of the gripper is operated so as to cut the chain link which then falls out of the apparatus together with the part to which it is soldered when, at the same time, the retaining device releases the part. While a new part is introduced into the retaining device, the carrier is moved toward the retaining device until the cut link abuts the part and a soldering mechanism is activated to solder the cut link and the part together. The carrier is then moved back the predetermined distance for repeating the chain engaging and cutting procedure.

With the apparatus according to the invention, the chain is not engaged and cut simply somewhere depending on its desired length but the engagement and cutting is done also depending on the contour of the chain, which again depends on the kind of chain links, and the very chain link to be cut is engaged and properly held by the gripper for the cutting process. The expression "contour" is to include not only the wave-type protrusions of a chain link in opposite directions normally out of its major plane but also radial projections of the chain link. Only when the end link, that is, the link to be cut, is exactly positioned with regard to the cutting plane and engaged by the gripper, the cutter is operated and the cutting step consequently is so performed that the link is cut exactly where the cut is intended to be with regard to a single link. The desired chain length is therefore not the only controlling factor for the cutting process of the apparatus according to the present invention but the chain length control is overridden to a limited degree by the contour location of the link to be cut so that the chain lengths may deviate to a limited degree from the desired length at the most by half the length of a chain link. Since, however, the end link is correctly positioned and the cutting process always provides for the correct cut, resulting always in the end link obtaining the optimum shape for soldering, the end link may then be properly joined to the member to which it is to be soldered and the soldering step may be performed flawlessly without breakdown of the apparatus. This results not only in clean and proper solder connections but also in trouble-free operations with high production capacities and very few rejects. For high cutting accuracy it is preferable that the grippers engaging the link to be cut extend up to the cutting plane and also serve as cutting edges for a cutting knife.

In order to determine exactly the position of the end link to be cut there is provided a contour sensor adapted to sense the contour of the chain link next to the link to be cut. Such sensor may be a sensing lever with an inductive or capacitive distance sensor or whose position may be determined opto-electronically. The lever has a feeler projection adapted in shape to the particular chain type to be handled. For a normal fashion chain it is generally sufficient to provide a feeler edge extending normal to chain length extension. In order to avoid excessive wear of the feeler edge and also to avoid damage to the chain, the lever is preferably provided with an air cushioned impact plate which assures that the sensing lever engages the chain always with the same and sufficient force. In such an arrangement it is advantageous to provide also a pneumatic operating mechanism.

The position sensor may also be an opto-electronic sensor utilizing, for example, simple light barriers which indicate, with a light-dark control arrangement, the contour of the chain or which determine the chain link opening position or it may be an advanced opto-electronic laser sensor utilizing even holographic methods to determine the chain link shape. The sensing receiver of the opto-electronic equipment may be a light conductor having its end disposed adjacent the link position next to the position of the end link. For chains of ferromagnetic materials also magnetic sensors may be utilized. The chain link position relative to the gripper may then be corrected by changing slightly the carrier position so as to move it by fractions of a length of the link of the chain while the chain is held tight from the part to which it is connected.

In order to permit movement of the carrier as desired it is advisable to use a stepping motor as the carrier drive, especially if the control for the apparatus includes a programmable computer. With such a computer it is easily possible to supply to the stepping motor drive pulses as required for a given chain length and to correct the carrier position depending on the position of the sensor until the gripper and the cutter are in the proper positions.

SHORT DESCRIPTION OF THE DRAWINGS

The drawings show schematically the apparatus according to the invention in connection with certain types of chains, that is:

FIGS. 1 and 2 show normal straight link chains;

FIGS. 3 and 4 show a "tank" chain;

DESCRIPTION OF A PREFERRED EMBODIMENT

Figure 5:
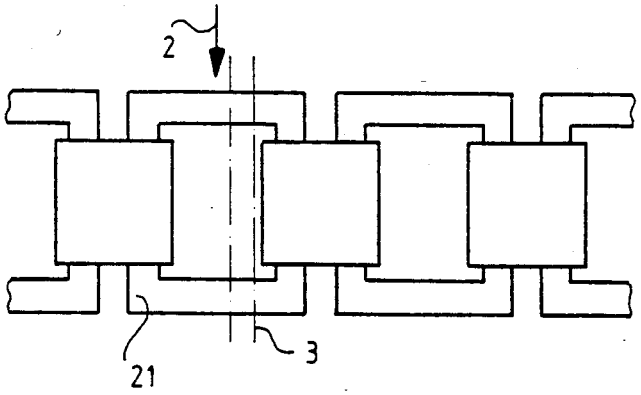
FIGS. 5 and 6 show a special fashion chain.
Figure 6:
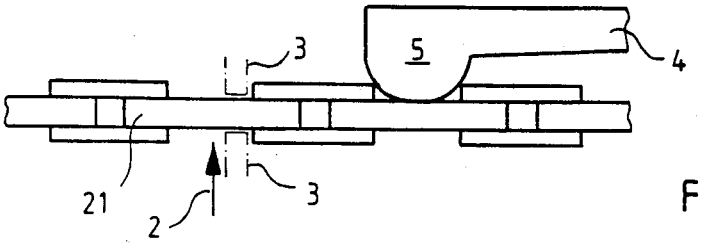

In order to be able to separate the chain link 1 of the simple link chain as shown in FIG. 1 correctly at the center as indicated by arrow 2, the chain link 1 must be engaged in the area indicated by the dash-dotted lines 3. The same is true for chain link 11 of FIGS. 3 and 4 and also for the link 21 of FIGS. 5 and 6. To make this possible a chain handling mechanism in accordance with the invention has a position sensor shown in the drawings as a sensing lever 4 with a feeler member 5. The sensing lever 4 is formed as a double arm lever pivotally supported on a support block 6 which is disposed on a carrier 8 that is movable back and forth along a line as indicated by arrow 7. Within the pivot range of the sensing lever 4 there is an inductive lever arm position sensor 9 which provides a lever arm position signal to a minicomputer 10. The carrier 8 also has a gripper 12 and a cutting mechanism as represented by arrow 13 disposed thereon. The cutting mechanism is directly adjacent the gripper 12. A chain holding mechanism 14 is shown mounted at one side of the carrier 8 and a retaining device 15 and soldering arrangement 16 are shown mounted at the other side of the carrier 8 with respect to the direction of carrier movement. The carrier 8 is moved by means of a carrier drive 17 which includes a stepping motor adapted for exact stepwise positioning of the carrier 8. Air jets 18 and 19 are disposed adjacent the sensing lever 4 so as to be capable of forcing the lever 4 onto the chain (jet 18) or lifting it therefrom (jet 19).

Figure 7:
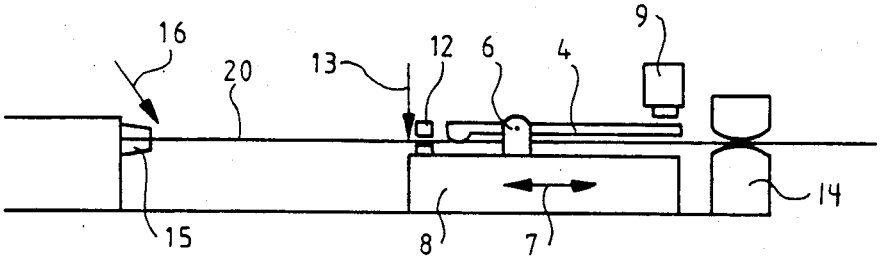
FIGS. 7 and 8 are schematic views of the automatic soldering apparatus.
Figure 8:
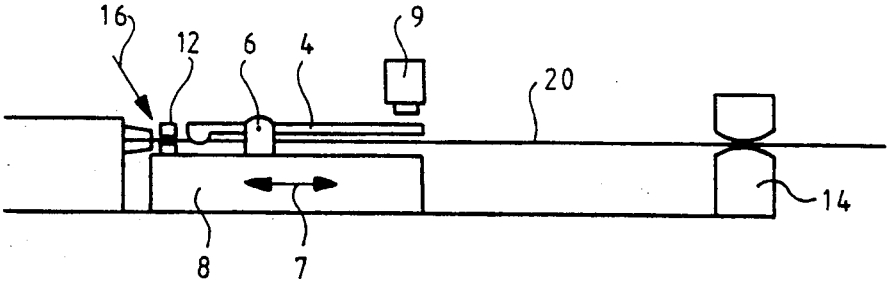
Figure 9:
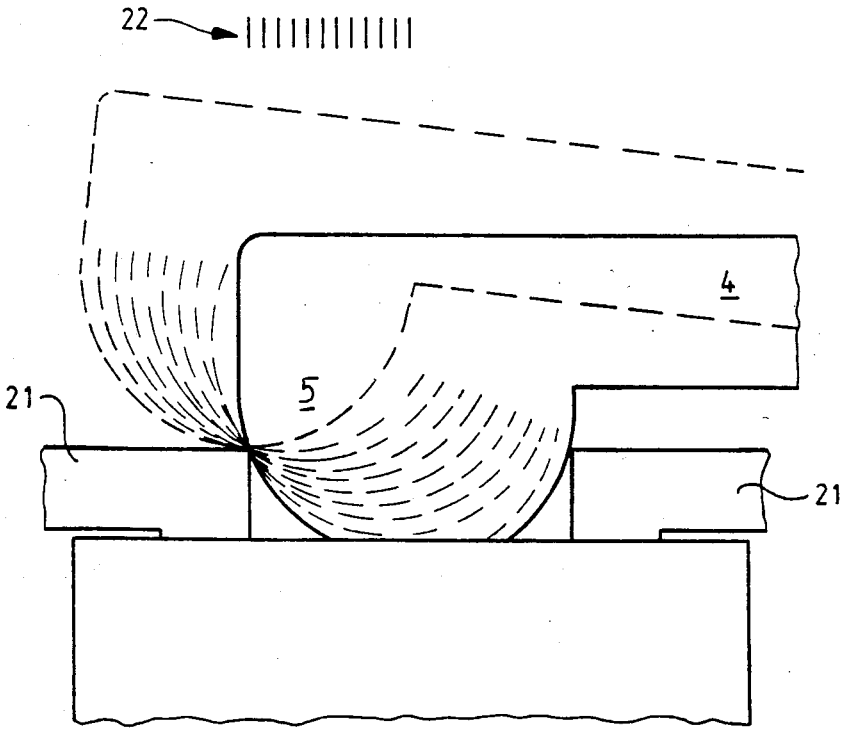
FIG. 9 is a detailed view of the position sensing lever.
Figure 10:
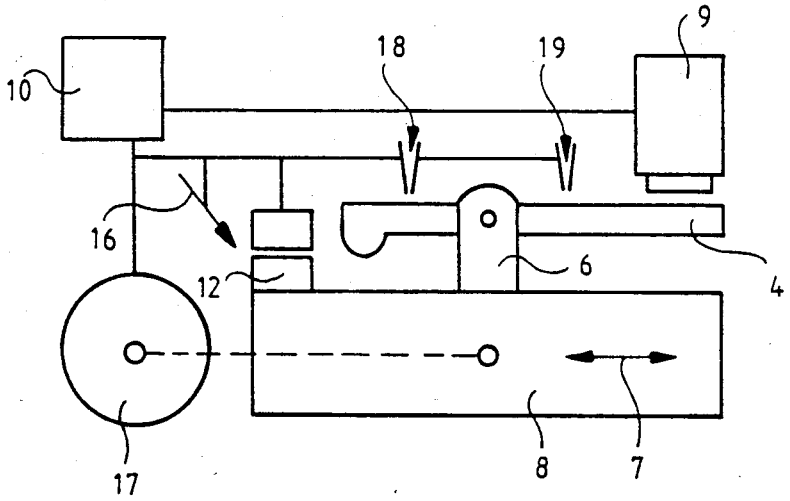
FIG. 10 shows schematically the control arrangement for the soldering apparatus.

The start of the soldering process is shown in FIG. 7. The part to be soldered to the chain 20 is engaged by the retaining device 15. For start up, the chain 20 is passed through the automatic soldering apparatus and manually soldered to the part retained in the retaining device 15. After tensioning the chain by means of a tensioning mechanism 14, the arrangement of the apparatus is as shown in FIG. 7 and the sensing lever 4 is biased toward the chain 20 by an air jet from the jet 18. FIG. 9 is an enlarged view showing the feeler member 5 in engagement with the chain 20, which feeler engagement depends on the position of a chain link relative to the feeler. Movement of the carrier 8 and, together therewith, of the sensing lever 4 in small steps 22, permits the feeler member 5 to move into depressions in the contour of the chain 20 until the lowest feeler position is reached. In this lowest position of the feeler member 5, which position is determined when the apparatus is prepared for a particular chain type, the computer 10, which remains informed of the sensing lever position by the position sensor 9, gives a signal to the gripper 12 which, as a result, engages a chain link 1, 11, 21 of the chain 20 as shown in FIGS. 1 to 6. Subsequently, the cutting mechanism is operated so as to cut the chain 20 such that the engaged chain link 1, 11, 21 is cut exactly in the desired plane. At the same time, the retaining device 15 is opened so that the part with the chain soldered thereon is released. At that point also the link half cut from the link engaged by the gripper 12 falls out of the chain. Now the computer instructs the drive 17 to move the carrier with the chain engaged by the gripper 12 toward the retaining device which meanwhile is provided with a new part to be soldered to the chain link engaged in the gripper 12 (FIG. 8). At the same time, the soldering mechanism 16 is energized to initiate the soldering operation. After the soldering step is completed, the gripper 12 opens and the carrier 8 is backed up from the retaining device a predetermined distance corresponding to the chain length to be cut (FIG. 7). During return of the carrier 8 the sensing lever 4 is removed from the chain 20 by operation of the air jet 19. After the carrier reaches the end of its predetermined travel distance, the sensing lever is again engaged with the chain by operation of air jet 18 and fine position control is repeated by sensing the position of the sensing lever as explained above, which position is determined by the inductive sensor 9 and supplied to the control computer.

I claim:

1. An apparatus for automatically soldering jewelry chains especially flexible jewelry chains to other parts such as other chain sections, chain locks, ornamental members or jewelry, said apparatus comprising: a retaining device for retaining the part to be soldered to the chain, a carrier supposed so as to be movable toward, and away from, said retaining device, means for controlling the movement of said carrier depending on the desired length of a chain section to be soldered to said part, said carrier having disposed thereon a gripper adapted and shaped to engage said chain so as to hold a portion of a link of said chain, which link is to be soldered to said part, a chain position sensor disposed on said carrier adjacent said gripper and adapted to engage discontinuities in the chain contour so as to determine the exact position of a chain link relative to said gripper, a control device adapted to receive position signals from said chain position sensor and to operate said means for controlling carrier movement into a desired position such that the gripper when energized engages a particular chain link in a predetermined manner, a cutting mechanism disposed adjacent said gripper so as to be able to cut the chain link engaged by said gripper, and a soldering mechanism disposed adjacent said retaining device for soldering the cut chain link to the part retained in the retaining device upon movement of the carrier toward the retaining device for abutting engagement of the cut link with the part to be soldered thereto.

2. An apparatus according to claim 1, wherein said gripper is formed so as to include a cutting edge for a chain-cutting knife.

3. An apparatus according to claim 1, wherein said chain position sensor is adapted to sense the position of the chain link next to the chain link to be cut.

4. An apparatus according to claim 1, wherein said chain position sensor is a sensing lever having a feeler member at one end thereof adapted to abut the chain and a capacitive distance sensor disposed adjacent said lever.

5. An apparatus according to claim 4, wherein said position sensing lever includes an air cushioned feeler plate.

6. An apparatus according to claim 1, wherein said position sensor is an opto-electronic sensing device.

7. An apparatus according to claim 6, wherein said opto-electronic sensing device includes a light conductor disposed next to said gripper so as to be adjacent the chain link next to the link to be cut.

8. An apparatus according to claim 7, wherein a laser light is used as light source for the opto-electronic sensing device.

9. An apparatus according to claim 1, wherein said position sensor is a magnetic sensor.

10. An apparatus according to claim 1, wherein said carrier drive means includes a stepping motor.

* * * * *